US008464446B1

(12) United States Patent
Dinon

(10) Patent No.: US 8,464,446 B1
(45) Date of Patent: Jun. 18, 2013

(54) PORTABLE IRONING PAD ASSEMBLY

(76) Inventor: Susan M. Dinon, Humarock, MA (US)

( * ) Notice: Subject to any disclaimer, the term of this patent is extended or adjusted under 35 U.S.C. 154(b) by 175 days.

(21) Appl. No.: 13/066,436

(22) Filed: Apr. 14, 2011

(51) Int. Cl.
*D06F 83/00* (2006.01)
*D06F 71/00* (2006.01)

(52) U.S. Cl.
USPC ..... 38/140

(58) Field of Classification Search
USPC ..... 150/158, 165
See application file for complete search history.

(56) References Cited

U.S. PATENT DOCUMENTS

| | | | | |
|---|---|---|---|---|
| 508,595 | A | 11/1893 | Barrett | |
| 1,159,156 | A | 11/1915 | Bass | |
| 1,339,831 | A | 5/1920 | Locke | |
| 1,570,955 | A | 1/1926 | Evans | |
| 2,608,749 | A | 9/1952 | Obitz | |
| 3,007,267 | A * | 11/1961 | Goldsmith | 38/140 |
| 3,217,137 | A * | 11/1965 | Weitzner | 219/201 |
| 3,719,220 | A * | 3/1973 | Small | 160/108 |
| 4,030,200 | A | 6/1977 | Francis | |
| 4,043,062 | A | 8/1977 | Lehrman | |
| 4,360,984 | A | 11/1982 | Ruttenberg | |
| 4,621,003 | A | 11/1986 | O'Kane | |
| 5,392,543 | A | 2/1995 | Lehrman | |
| 5,647,421 | A * | 7/1997 | Hoffmann et al. | 160/120 |
| 6,374,896 | B1 | 4/2002 | Moller | |
| 6,793,991 | B2 | 9/2004 | Thuma et al. | |
| 7,131,223 | B2 | 11/2006 | Krotts et al. | |
| 7,299,573 | B1 | 11/2007 | Kuncken | |
| 7,409,786 | B2 | 8/2008 | Lee | |
| 2003/0136034 | A1 | 7/2003 | Lehrman | |
| 2009/0000164 | A1 | 1/2009 | Scheipe | |
| 2011/0059309 | A1 * | 3/2011 | Purdy | 428/304.4 |

* cited by examiner

*Primary Examiner* — Ismael Izaguirre
(74) *Attorney, Agent, or Firm* — John P. McGonagle

(57) ABSTRACT

A portable, ironing pad comprised of a pad adapted to snugly roll up within a cylindrical tubular housing is provided. The pad is spring loaded within the holder. The pad is comprised of a thin, foam material with an outer covering on both the bottom and top outer surfaces, said outer covering coated with a heat-resistant, nonstick, moisture repellent substance such as that sold under the trademark, TEFLON.

5 Claims, 3 Drawing Sheets

PORTABLE IRONING PAD ASSEMBLY

BACKGROUND OF THE INVENTION

This invention relates to ironing pads, and in particular, to a portable, ironing pad adapted to be used on top of a bed, table, or any substantially horizontal and planar surface.

It is often quite necessary for travelers to iron various items. The prior art provides various types of small irons to iron such items; however, the problem has been that it is difficult to find a suitable place in a hotel or vacation spot to do such ironing. Although furniture with flat horizontal surfaces are generally available, the surfaces can be damaged if a garment is spread out upon the surface and the garment ironed.

Conventional ironing boards include a rigid base supported by a plurality of foldable legs and are, therefore, too bulky for travelers to take with them. The prior art provides flexible portable pads which are adapted to be rolled upon themselves and stored and carried in a bag and which can be removed from the bag, unrolled and positioned on a table to be utilized as an ironing board. However, these portable pads are bulky, occupying valuable space in a traveler's bags.

SUMMARY OF THE INVENTION

The present invention solves some of the aforementioned problems by providing a portable, ironing pad which is comprised of a pad adapted to snugly roll up within a cylindrical tubular housing. The pad is spring loaded within the holder. The pad is comprised of a thin, foam material with an outer covering on both the bottom and top outer surfaces, said outer covering coated with a heat-resistant, nonstick, moisture repellent substance such as that sold under the trademark, TEFLON, by the Du Pont Company, Wilmington, Del.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
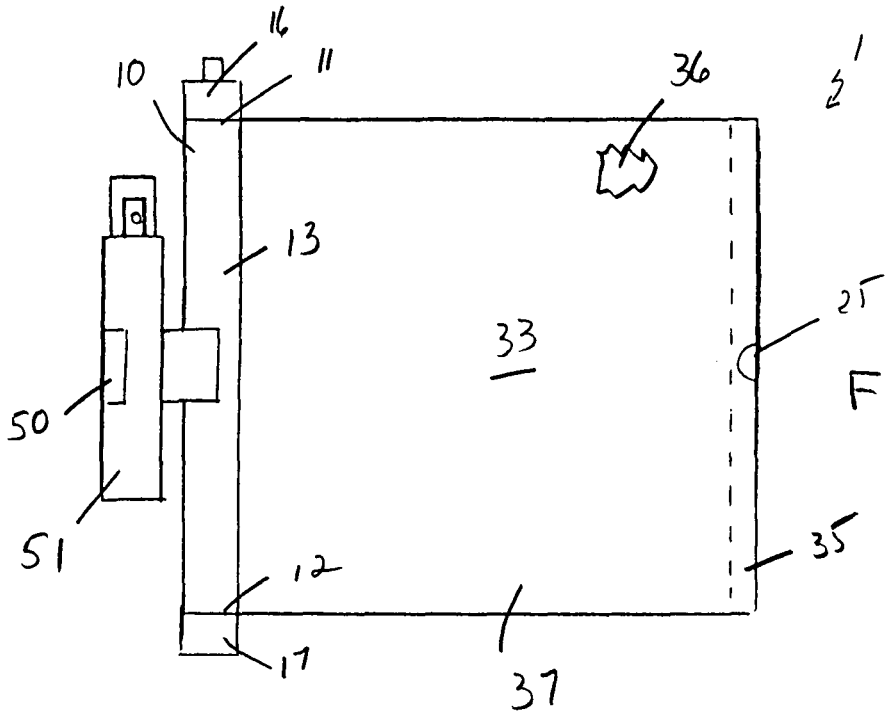
FIG. 1 is a top view of the assembly.
Figure 2:
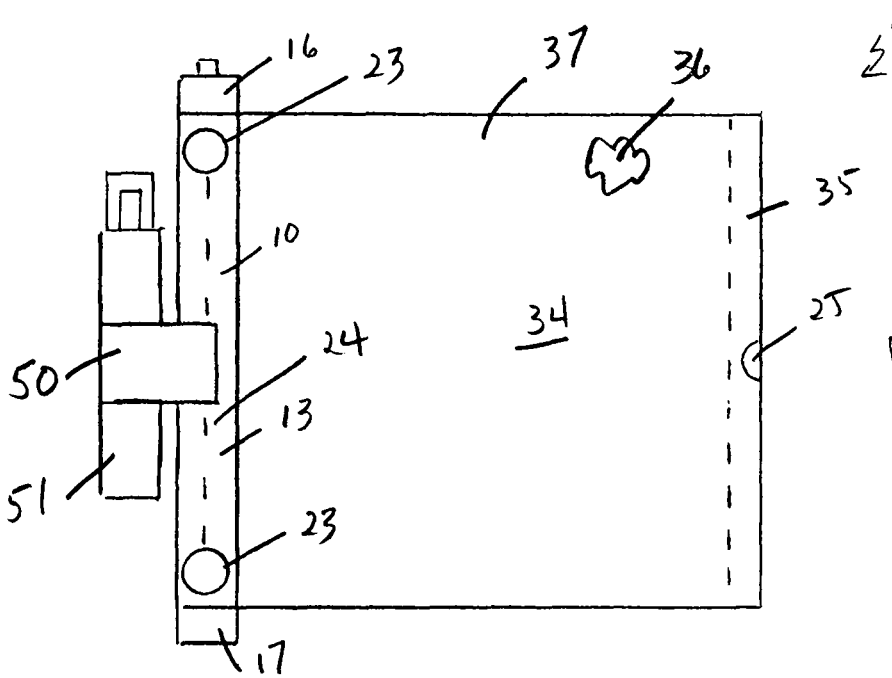
FIG. 2 is a bottom view of the assembly.
Figure 3:
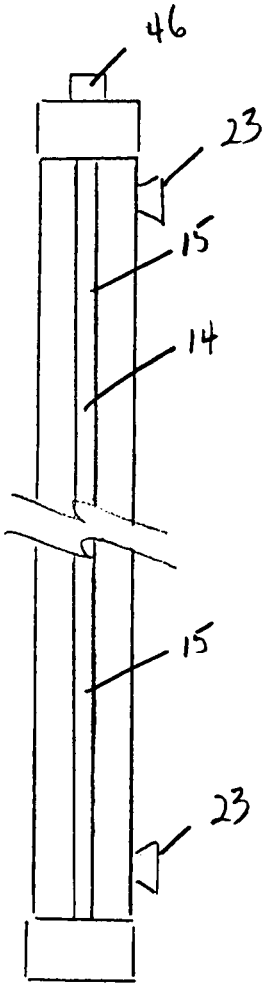
FIG. 3 is a side view of the housing.
Figure 4:
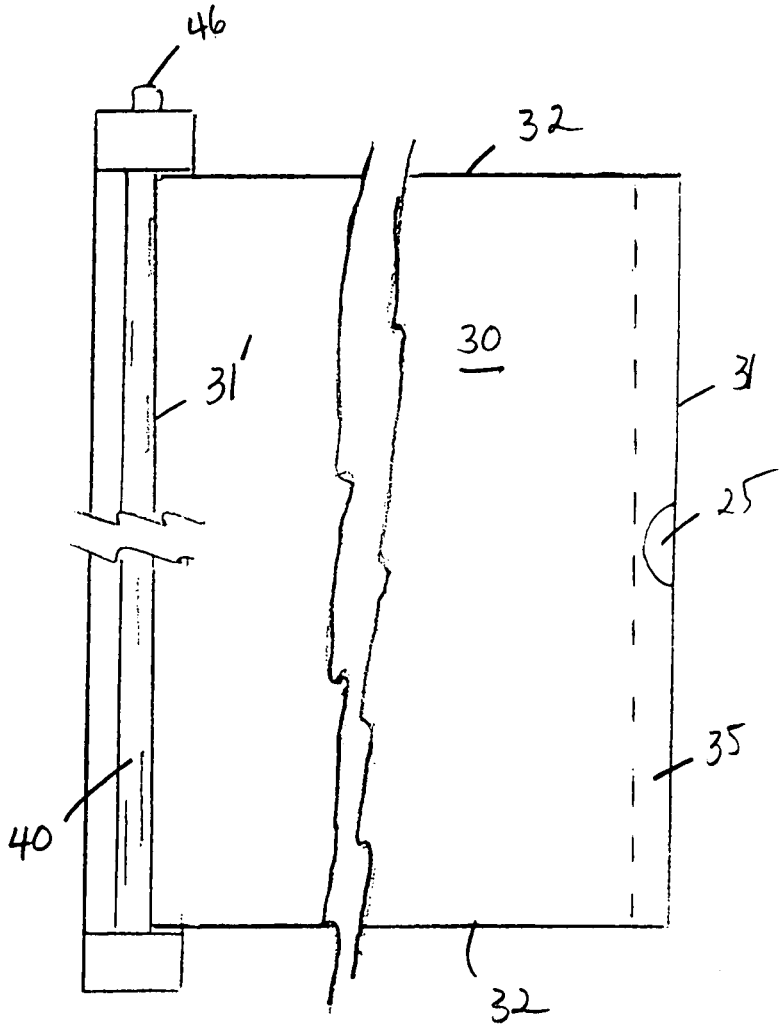
FIG. 4 is a top view of the assembly, partially in section.
Figure 5:
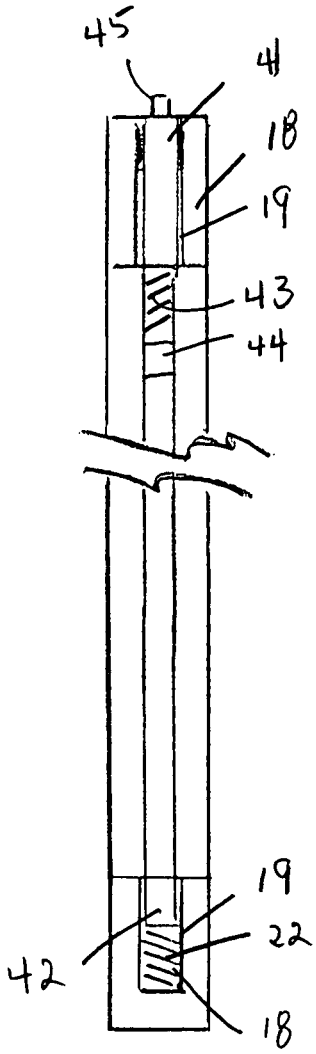
FIG. 5 is a cross sectional view of the housing.
Figure 6:
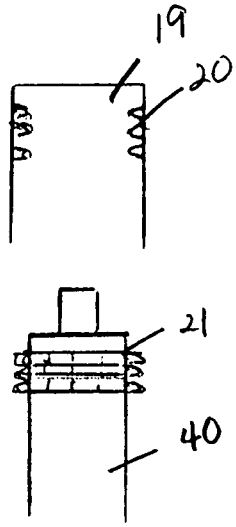
FIG. 6 is a close-up view, partially in section of the annular rings.
Figure 7:
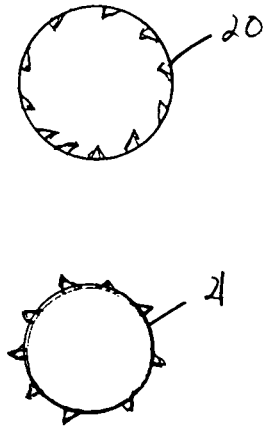
FIG. 7 is another view of the annular rings.

Referring to the drawings in detail wherein like elements are indicated by like numerals, there is shown a portable ironing pad assembly 1 comprised of a hollow, cylindrical, tubular housing 10 with a connected ironing pad 30. The housing 10 has two opposite ends 11, 12 and a cylindrical body 13 extending from one end 11 to the other end 12, said ends defining a housing longitudinal axis. The housing ends 11, 12 and body 13 define a housing interior 14. The cylindrical body 13 has a longitudinal slot 15 formed therein and extending nearly to each of the housing ends 11, 12, said slot 15 opening into the housing interior 14. The assembly 1 is further comprised of a generally rectangular, flexible, ironing pad 30 having two opposite major edges 31, two opposite minor edges 32, a top surface 33 and an opposite bottom surface 34. One of the ironing pad major edges 31' is attached to an elongated, hollow rod 40 positioned within the housing interior 14, said rod having two, opposite ends 41, 42. The other major edge 31 has a stiffener 35 attached thereto.

The housing opposite first and second ends 11, 12 are closed by means of two cap structures, a first cap structure 16 on said first housing end 11 and a second cap structure 17 on said second housing end 12. Each cap 15, 16 includes a plug section 18 having a close fit within the housing ends 11, 12. An internal cylindrical recess 19 extends into the plug section 18 coincident with said housing longitudinal axis to form a bearing surface for each rod end 41, 42. A torsion coil spring 43 is arranged within the rod 40 for normally biasing the rod 40 to a position wherein the ironing pad 30 is fully rolled up about the rod within the housing interior 14. One end of the coil spring 43 is anchored to a plug 44 within the rod. The other coil spring end is anchored to a cap structure 16, 17.

The first cap structure 16 has a female annular ring 20 with inwardly projecting teeth positioned within a first cap structure plug section recess 19. A corresponding male annular ring 21 with outwardly projecting teeth is attached to the first rod end 41. The teeth of both rings 20, 21 are arranged so that the rod 40 may be rotated on one direction but not in the opposite direction. The pad 30 may be then unwound from the rod 40 through the slot 14 a desired distance or until the pad is unwound from rod to the pad major edge 31'. The teeth arrangement prevents the coil spring 43 from rewinding the pad 30 about the rod 40 into the housing interior 14. The first rod end 41 has a protrusion 45 extending centrally through the first cap structure 16 and terminating in a button 46 outside of the housing 10. By pressing the button 46, the protrusion 45 exerts a longitudinal force against the rod first end 41 pushing the rod second end 42 further into the plug section recess 19 of the second cap structure 17. The rod male ring 21 is thereby disengaged from the female ring 20 allowing the coil spring to rotate the rod 40 thereby winding the ironing pad 30 onto the rod 40 within the housing interior 14. A compression spring 22 is fitted into the plug section recess 19 of the second cap structure 17 thereby tending to push the rod outward from the second cap structure plug section recess 19 as soon as longitudinal pressure on the rod button 46 is released. This causes the rod male annular ring 21 to re-engage with the female annular ring 20 holding the ironing pad 30 in position about the rod 40.

The ironing pad 30 is further comprised of a thin, foam material 36 with an outer covering 37 on both the top and bottom surfaces 33, 34. The outer covering 37 is coated with a heat-resistant, nonstick, moisture repellent substance such as that sold under the trademark, TEFLON.

The housing body 13 has two suction cups 23 attached thereto, each near to a housing end 11, 12 along a longitudinal line 24, parallel to the housing longitudinal axis and radially positioned approximately 90° from the longitudinal slot 15. The major edge 31 with attached stiffener 35 may have a central grip 25 formed therein. The central grip may be as simple as a thumbhole or a raised ridge.

The ironing pad assembly 10 is further comprised of at least one clip 50 removably attached to the housing 10, said clip adapted to hold a spray bottle 51. The spray bottle holds water and is useful for ironing. If the attached spray bottle is not desired, the bottle and clip(s) can be removed from the assembly 1.

It is understood that the above-described embodiment is merely illustrative of the application. Other embodiments may be readily devised by those skilled in the art which will embody the principles of the invention and fall within the spirit and scope thereof.

I claim:

1. A portable, ironing pad assembly, comprising:

a hollow, cylindrical, tubular housing;

a generally rectangular, flexible ironing pad adapted to snugly roll up within said tubular housing, said pad being loaded within the holder, said pad comprised of a thin, foam material with an outer covering on both the bottom and top outer surfaces, said outer covering coated with a heat-resistant, nonstick, moisture repellent substance;

wherein said housing has two opposite ends, a first housing end and a second housing end, and a cylindrical body extending from one end to the other end, said housing ends defining a housing longitudinal axis, said housing ends and body defining a housing interior, aid cylindrical body having a longitudinal slot formed therein and extending nearly to each of the housing ends, said slot opening into the housing interior;

wherein said ironing pad has two opposite major edges and two opposite minor edges, one of said major edges being attached to an elongated, hollow rod positioned within the housing interior, said rod having two, opposite ends, a first rod end and a second rod end;

a first cap structure on said first housing end and a second cap structure on said second housing end, each cap structure including a plug section having a close fit within the housing first and second ends;

an internal cylindrical recess extending into each plug section coincident with said housing longitudinal axis to form a bearing surface for each rod end;

a torsion coil spring arranged within the rod for normally biasing the rod to a position wherein the ironing pad is fully rolled up about the rod within the housing interior, said coil spring having one end anchored to a plug within the rod, said coil spring having another end anchored to a cap structure;

a female annular ring with inwardly projecting teeth positioned within a first cap structure plug section recess;

a corresponding male annular ring with outwardly projecting teeth attached to the first rod end;

wherein teeth of both rings are arranged so that the rod may be rotated on one direction but not in the opposite direction, said teeth arrangement preventing the coil spring from rewinding the pad about the rod into the housing interior;

a protrusion from said first rod end extending centrally through the first cap structure and terminating in a button outside of the housing, said button adapted to translate external force longitudinally against the rod first end pushing the rod second end further into the plug section recess of the second cap structure, thereby disengaging the rod male ring from the female ring allowing the coil spring to rotate the rod thereby winding the ironing pad onto the rod within the housing interior;

a compression spring fitted into the plug section recess of the second cap structure, said compression spring tending to push the rod longitudinally out of the said plug section recess as soon as longitudinal pressure on the button is released thereby causing the rod male annular ring to re-engage with the female annular ring holding the ironing pad in position about the rod.

2. A portable ironing pad assembly as recited in claim 1, further comprising:

a stiffener attached to said ironing pad other major edge.

3. A portable ironing pad assembly as recited in claim 2, further comprising:

two suction cups attached to said housing body, each said suction cup attached near to a housing end along a longitudinal line, parallel to the housing longitudinal axis and radially positioned approximately 90° from the longitudinal slot.

4. A portable ironing pad assembly as recited in claim 3, further comprising:

a central grip formed in the major edge with attached stiffener.

5. A portable ironing pad assembly as recited in claim 4, further comprising:

a spray bottle removably attached to said housing body;

at least one clip removably attached to said housing body, said clip adapted to removably hold said spray bottle.

* * * * *